US009745159B2

(12) United States Patent
Fulleringer

(10) Patent No.: US 9,745,159 B2
(45) Date of Patent: Aug. 29, 2017

(54) MIX MAIL FEEDER

(71) Applicant: NEOPOST TECHNOLOGIES, Bagneux (FR)

(72) Inventor: Nicolas Fulleringer, Piolenc (FR)

(73) Assignee: Neopost Technologies, Bagneux (FR)

( * ) Notice: Subject to any disclaimer, the term of this patent is extended or adjusted under 35 U.S.C. 154(b) by 0 days.

(21) Appl. No.: 14/993,770

(22) Filed: Jan. 12, 2016

(65) Prior Publication Data

US 2016/0214815 A1 Jul. 28, 2016

(30) Foreign Application Priority Data

Jan. 28, 2015 (EP) ..... 15305099

(51) Int. Cl.

| | |
|---|---|
| ***B65H 7/02*** | (2006.01) |
| ***B65H 3/06*** | (2006.01) |
| *B65H 3/12* | (2006.01) |
| *B65H 3/52* | (2006.01) |
| *B65H 1/06* | (2006.01) |

(52) U.S. Cl.

CPC ..... *B65H 7/02* (2013.01); *B65H 3/063* (2013.01); *B65H 1/06* (2013.01); *B65H 3/126* (2013.01); *B65H 3/523* (2013.01); *B65H 2511/152* (2013.01); *B65H 2511/51* (2013.01); *B65H 2511/515* (2013.01); *B65H 2513/10* (2013.01); *B65H 2513/21* (2013.01); *B65H 2701/1916* (2013.01)

(58) Field of Classification Search

CPC ..... B65H 3/523; B65H 3/5238; B65H 3/126; B65H 3/042; B65H 3/085; B65H 1/06; B65H 3/063; B65H 7/14; B65H 7/04; B65H 7/02; B65H 2513/21; B65H 2511/152

See application file for complete search history.

(56) References Cited

U.S. PATENT DOCUMENTS

| | | | | |
|---|---|---|---|---|
| 5,149,076 A * | 9/1992 | Stenz | ..... | B65H 3/126 271/104 |
| 6,629,916 B2 * | 10/2003 | Vijuk | ..... | B65H 3/063 493/13 |
| 2004/0130091 A1 * | 7/2004 | Driggers | ..... | B65H 1/06 271/119 |

(Continued)

FOREIGN PATENT DOCUMENTS

| | | |
|---|---|---|
| EP | 0543559 A1 | 5/1993 |
| EP | 2199237 A1 | 6/2010 |

(Continued)

OTHER PUBLICATIONS

European Search Report, EP Application No. 15305099, dated Aug. 11, 2015, 2 pages.

*Primary Examiner* — Jeremy R Severson

(74) *Attorney, Agent, or Firm* — Seed IP Law Group LLP

(57) ABSTRACT

A feeder (12) for feeding envelopes in a mail handling machine comprising a transport deck (30) for receiving a stack of envelopes, feed rollers (34) for conveying downstream envelopes towards a reference wall (32) leaving a clearance path for the envelopes; a stack sensor (48) for detecting the presence of the stack of envelopes at a predetermined height threshold; and a control unit (46) configured for decreasing acceleration of the feed rollers when the stack of envelopes goes below the predetermined height threshold.

20 Claims, 2 Drawing Sheets

(56) References Cited

U.S. PATENT DOCUMENTS

| | | | | |
|---|---|---|---|---|
| 2006/0087070 | A1* | 4/2006 | Cook | B65H 1/00 271/145 |
| 2008/0122159 | A1* | 5/2008 | Pillard | B65H 1/30 271/3.05 |
| 2009/0057987 | A1 | 3/2009 | Matsumoto | |
| 2010/0044948 | A1* | 2/2010 | Sardella | B65H 3/042 271/3.16 |

FOREIGN PATENT DOCUMENTS

| | | | |
|---|---|---|---|
| EP | 2292540 | A1 | 3/2011 |
| EP | 2586737 | A2 | 5/2013 |
| JP | 2001088958 | A | 4/2001 |

* cited by examiner

MIX MAIL FEEDER

BACKGROUND

Technical Field

The present application relates to a mail separating device. More specifically it relates to a device incorporated into a feeder of a mail processing machine such as for instance a franking or sorting machine. The device can be used to separate letters or flats of various thickness and size, which may form homogeneous or heterogeneous batches.

Description of the Related Art

In automatic franking machines, mail is generally loaded as a batch, or stack, from which the envelopes must be separated. This process, also referred as singulation, is necessary to detect the leading edge of each envelope in order to print the franking mark at the right position. Moreover a certain gap shall be left between successive envelopes so that the machine has enough time to calculate the postage and print the franking mark before another envelope is detected. Advanced franking machines are also capable of measuring and weighing each envelope to calculate the appropriate postage rate. It is easily understood that double or multiple feed may cause either a jam or a malfunction of the franking process.

The problem is further complicated in a mix mail environment because of the various thickness, size, weight and materials of the envelopes. Indeed, mail batches can be either homogeneous or heterogeneous. In the last case envelope properties will not only vary from one batch to another, but also within the same batch. In the case of homogeneous batches the operator may adjust some parameters of the franking machine in order to cope with the properties of the batch. This is not possible in the case of a heterogeneous batch. Such adjustments are anyway not desirable due to the risk of errors and required productivity. The franking machine must therefore accept a wide range of mixed envelopes without settings.

Additionally high speed machines are designed so that mail can be reloaded on the fly, which brings other limitations. For instance when the batch is disposed vertically—with envelopes on top of each other—it is required to put the largest envelopes at the bottom and the smallest at the top so that the stack remains stable. The operator must wait until the small envelopes of the previous batch have been separated before reloading large envelopes.

Although other principles are possible, most franking machines use differential friction to separate envelopes. At least one driving belt or roller is arranged at the bottom of the stack to pull the first envelope away while the following ones are held by a retaining mechanism. This is possible because the friction between the driving belt or roller and the first envelope is higher than between the first and second envelopes. The retaining mechanism is either a set of friction pads or a belt moving in the direction opposite to the driving belt or roller. This mechanism is generally arranged to form a slope or funnel in order to stagger the envelopes.

Of course the friction force generated by the retaining mechanism is lower than the force generated by the driving belt or roller, so that a single envelope can pass through. As envelopes are separated, the stack becomes smaller and the pressure on the first envelopes decreases until there is only one envelope left. The last two envelopes must be separated whatever their size, weight or thickness.

Thus, for ensuring a perfect separation, many parameters can be adjusted: friction coefficient of the driving and retaining belts, rollers or pads, number disposition, angle and pressure of the retaining belt or pads, number, disposition, speed and acceleration of the driving and retaining belts or rollers. However it is not always possible to find a compromise which ensures separation of letters in all mail batch configurations, notably with the requirement of no operator settings. In particular, parameter values ensuring good separation of the bottommost envelope of a large and heavy batch may not be optimal when the batch is down to a few letters.

Another aspect to take into account is the dispersion of friction coefficient between letters. The friction coefficient is not equal between all envelopes, even in homogeneous batches. When the stack is accelerated by the feed rollers, it tends to split where the friction is the lowest and form blocks of envelopes temporarily bound together. Once formed, these blocks can be difficult to break down into single envelopes. It has been observed that the friction between envelopes tends to decrease with repeated sliding. The decrease of static friction can be of 20% after the third sliding. In other words, once a block is formed, its outermost envelopes tend to slide better against adjacent blocks.

Several solutions exist to automatically adjust some parameter values in relation to the mail batch configuration, and notably to the weight, or height, of the batch.

EP2199237 discloses a method of controlling and varying the drive speed of a motor driven conveyor in function of the weight of a stack of mailpieces standing on a receiving deck, in order to extract sail mailpieces one-by-one. It is known from academic studies that the friction coefficient for paper on rubber i) decreases with the applied load and ii) increases with differential speed. In a preferred embodiment, the weight of the stack is obtained from a weighing unit that carries the mailpiece receiving deck. The weight is constantly monitored and the drive speed decreases linearly as the stack decreases. The drive speed is thus at a maximum when the stack of mailpieces is the heaviest. Though the application of at higher drive speed for heavy stacks compensates the lowest friction coefficient to some extent, it only works insofar that the conveyor starts sliding on the bottommost envelope. This can result in soiling or even damaging the thinnest envelopes. Moreover the design of the weighing unit is rather complex and the weight signal is not accurate enough for other purposes, like for instance calculating the postage amount for each extracted envelope.

EP2586737 discloses an apparatus for processing items having a feed station with an ejection roller operable to remove an item from a stack of mail, and comprising a pressure element mounted to pivot and configured to exert a pressure force on said stack that causes a bottommost item of mail in said stack to be pressed against said ejection roller. The pressure element is configured to change said pressure force in dependence on a loss of weight of said stack due to removal of said bottommost item of mail. As the stack of mail decreases, the load applied by the pressure element increases and compensates the loss of weight. This is particularly useful when the stack is down to a few letters. It is indeed a problem for many separation devices to extract the very last letters because the small remaining weight does not generate enough friction against the ejection roller. However, the pressure element applies an extra load when the stack is the heaviest, thus increasing the risk of double-feed and limiting the capacity of the feeder. The pressure element represents an additional cost and is not convenient when the feeder has to be reloaded on the fly.

EP2292540 discloses a device having a clutch unit for actuating drive rollers that support a stack of mailpieces. An optical sensor detects the passage of the mailpieces entering into a separation zone that individually selects the mailpieces. A control unit controls repeated activation/deactivation of the clutch unit as long as the sensor is not activated, to cause a jerky motion of the stack for facilitating mutual separation of the mailpieces. The rapid succession of horizontal movements has indeed the effect of breaking down blocks of letters that are bound together and might not be separated properly. Though this method is particularly useful for heavy stacks it does not provide any advantage when the stack is down to a few letters, as it does not generate more friction against the drive rollers. When the stack is small the friction force may not be enough to drive the very last letters through the separation mechanism, and repeated activation/deactivation of the clutch unit may not generate any movement but only result in soiling or even damaging the thinnest envelopes.

BRIEF SUMMARY

It is an object of the invention to solve the problems of the prior art, and notably to cope with the variation of the weight of the stack. It is another object of the invention to enlarge the capacity of the feeder while ensuring proper separation of the letters whatever the size of the stack. It is a further object of the invention to achieve these goals without significantly increasing the cost or the complexity of the franking machine.

These objects are achieved by a feeder for feeding envelopes in a mail handling machine comprising a transport deck for receiving a stack of envelopes, feed rollers for conveying downstream envelopes towards a reference wall leaving a clearance path for the envelopes, a stack sensor for detecting the presence of said stack of envelopes at a predetermined height threshold; and a control unit for activating the feed rollers, wherein the control unit configured for decreasing acceleration of said feed rollers when the stack of envelopes goes below said predetermined height threshold.

The height of the stack is generally correlated with its weight, and in most cases, the upper envelopes in the stack are the smallest and the lightest ones. However, even if these last envelopes are heavy, applying a lower acceleration to the feed roller is not detrimental to the separation process. Indeed, high acceleration is desirable when the stack is heavy (ideally up to 300 $m/s^2$ for very heavy stacks). In this case, the inertia of the envelopes just above the bottommost one facilitates the separation process. Adversely, when the stack is light, a lower acceleration is desirable to avoid the slippage of the feed rollers against the bottommost envelope.

One advantage of using this embodiment is that envelopes can be reloaded on the fly even after the stack has reached the predetermined height threshold. As soon as the stack sensor detects the presence of envelopes above the predetermined height threshold, the initial, higher, value of acceleration can be restored.

Preferably, said acceleration is decreased from a first acceleration (higher acceleration of typically 100 $m/s^2$) to a second acceleration (lower acceleration of typically 20 $m/s^2$).

Said control unit can be further configured for maintaining a top speed of said feed rollers when the stack of envelopes goes below said predetermined height threshold or for limiting a top speed of said feed rollers when the stack of envelopes goes below said predetermined height threshold.

Advantageously, said reference wall extends vertically from said transport deck.

Preferably, said stack sensor (i.e., a contact sensor protected by a small articulated lever or an optical reflective sensor) is placed in said reference wall just above said clearance path.

The feeder further comprises a feed sensor located below said transport deck and near said reference wall and friction pads facing separation rollers for ejecting one by one said envelopes from said stack.

Advantageously, said control unit is further configured for, in an initialization phase, if said envelopes are detected by said feed sensor, activating said feed rollers to advance the entire stack of envelopes towards the reference wall at moderate speed.

The embodiments of the invention also relate to a mail handling machine comprising a feeder as previously shown.

BRIEF DESCRIPTION OF THE SEVERAL VIEWS OF THE DRAWINGS

The embodiments of the invention can be better understood in reading the following detailed description accompanied by illustrative and non-limiting examples with reference to the drawings, in which.

DETAILED DESCRIPTION

Figure 1:
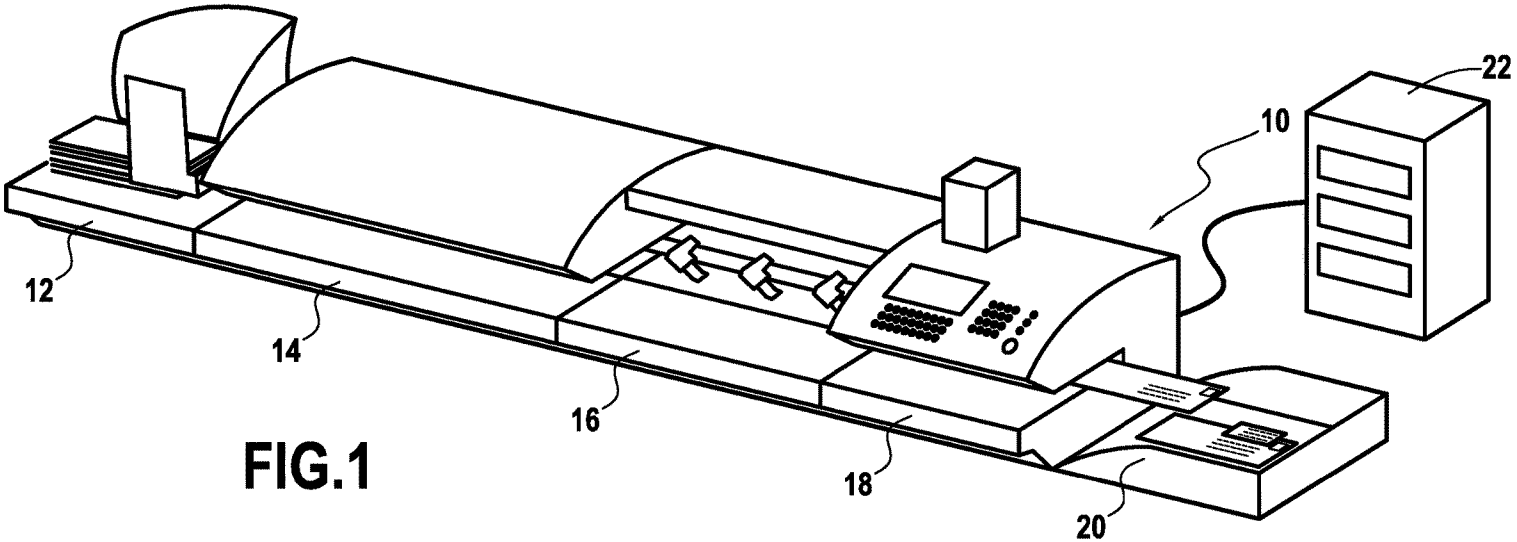
FIG. 1 is a view of a franking machine in which the invention can be implemented.

The embodiments of the invention will be better understood with a brief explanation of the forces acting on the envelopes in the stack. The model presented here is extremely simplified and shall serve only as an illustration of the main principles governing the separation of mail. In the following, the drive rollers located in the upstream part of the feeder are called feed rollers.

The feed rollers acting on the bottommost envelope have a static coefficient of friction $\mu s^{re}$. The dynamic coefficient of friction is considered equal to the static one insofar that there is no significant differential speed between the rollers and the bottommost envelope.

The friction pads retaining the envelopes just above the bottommost one have a static coefficient of friction $\mu s^{pe}$ and a kinetic coefficient of friction $\mu k^{pe}$. They form an angle $\theta$ with the horizontal plane. They apply a vertical downward force S to the envelopes.

The envelopes have mutual static and kinetic coefficient of friction $\mu s^{ee}$ and $\mu k^{ee}$.

The stack has a weight W, which varies during the separation process.

We consider $\mu s^{ee}=0.6$; $\mu k^{ee}=0.5$; $\theta=18°$; S=600 gr; $\mu s^{pe}=\mu k^{pe}=1$; $\mu s^{re}=\mu k^{re}=2$.

Double Feed

A double (or multiple) feed occurs when two (or more) envelopes are bound in a block and pass together through the separation mechanism. The friction between envelopes belonging to the block is greater than the separation forces acting on the block boundaries.

The force driving the uppermost envelope of the block is $D=W*(\mu s^{ee}-\mu k^{ee})$ where the weight of the entire stack W is considered much bigger than the weight of envelopes in the block.

The uppermost envelope of the block shall lift the friction pad thus $W*(\mu s^{ee}-\mu k^{ee})>S*\tan\theta$.

Then the uppermost envelope of the block shall not be retained by the friction pad, thus $W*(\mu s^{ee}-\mu k^{ee})>S*(\mu k^{pe}-\mu s^{ee})$. These conditions are more likely to be met with heavy stacks.

The first condition is: W*0.1>600*0.325 thus W>1950 grams (gr).

The second condition is: W*0.1>600*0.4 thus W>2400 gr.

The last one gives a realistic value of the weight where double feeds start occurring.

The maximum capacity of the feeder is therefore limited by the weight of the stack.

Miss-Feed

A miss-feed occurs when the very last envelopes of the stack cannot be extracted. This is the case because there is not enough friction generated by the stack against the drive rollers.

The force driving the bottommost envelope is then $D=W*(\mu s^{re}-\mu k^{ee})$. In order to pass the friction pads the driving force shall be greater than $S*\tan\theta$. The condition is met for a weight such that W*1.5>600*0.325 thus W>130 gr, corresponding to a dozen of envelopes. (In practice, an additional grip is generated by the compression of the envelopes engaging under the friction pads. The above value is therefore overestimated, but the extraction of the very last letters often remains problematic).

These simple calculations show that the weight of the stack, and thus the capacity or the feeder is limited. Furthermore it can be easily demonstrated that modifying a parameter to increase the capacity of the feeder, for instance increasing the angle θ or the separation load S, may have a detrimental effect on the feeding of the envelopes when the stack becomes smaller. Moreover, as automatic franking machines operate at high speed and acceleration, typically 1 m/s and 100 $m/s^2$, the inertia of the envelopes is not negligible. The force required to accelerate a mass of 10 gr at 100 $m/s^2$ is D=1 N or ~100 gr. In comparison, the force acting on the bottommost envelope can be lower than 50 gr when the stack is down to a few letters, and the rollers may very well start slipping before the bottommost envelope is driven through the separation mechanism.

Conventionally, a franking machine 10 as illustrated in FIG. 1 comprises disposed from upstream to downstream in the direction of advance of the envelopes: a receiving deck 12 designed to receive a stack of mail items (typically envelopes of the mixed type, i.e., of different sizes and weights); a selector and conveyor module 14 for selecting the envelopes and conveying them one-by-one (both forming the feeding module of the franking machine); preferably a dynamic weighing module 16 for determining the weight and optionally the size of each selected envelope; a franking module 18 designed to print the franking mark on each of the envelopes selected one-by-one and weighed on the fly in this way; and a stacker or a tray 20 for receiving the franked envelopes. The franking module classically has a user interface that makes it possible, in particular, to select the class of mail and other postal services. Preferably, and also as is known, said franking module is connected to a remote server 22 of a dealer of the franking machine, which machine is also connected to a server (not shown) of a postal authority or of a private carrier who delivers the mail items.

Figure 2A:
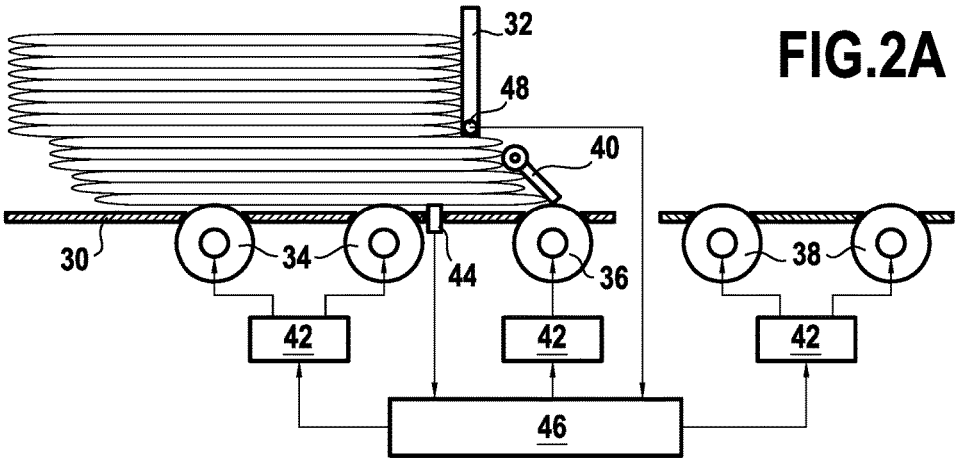
FIGS. 2A, 2B and 2C are schematic views of a feeder according to the invention containing respectively a high, intermediate and low stack.
Figure 2B:
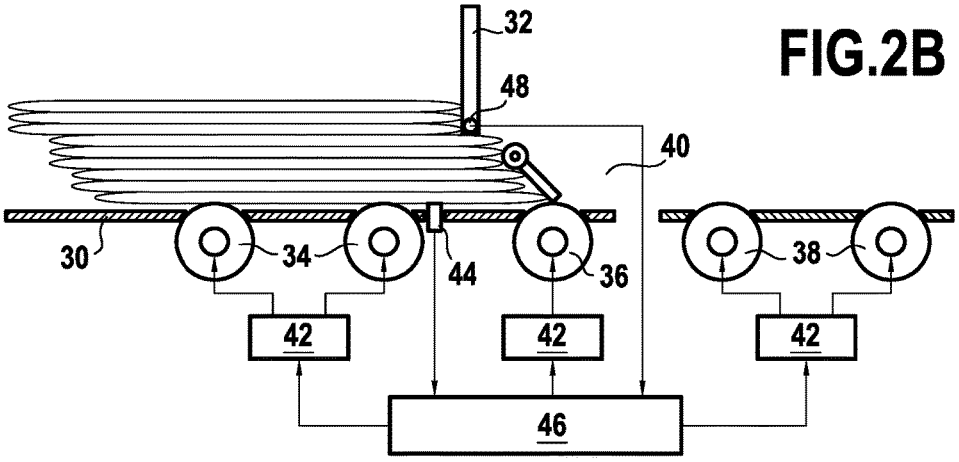
Figure 2C:
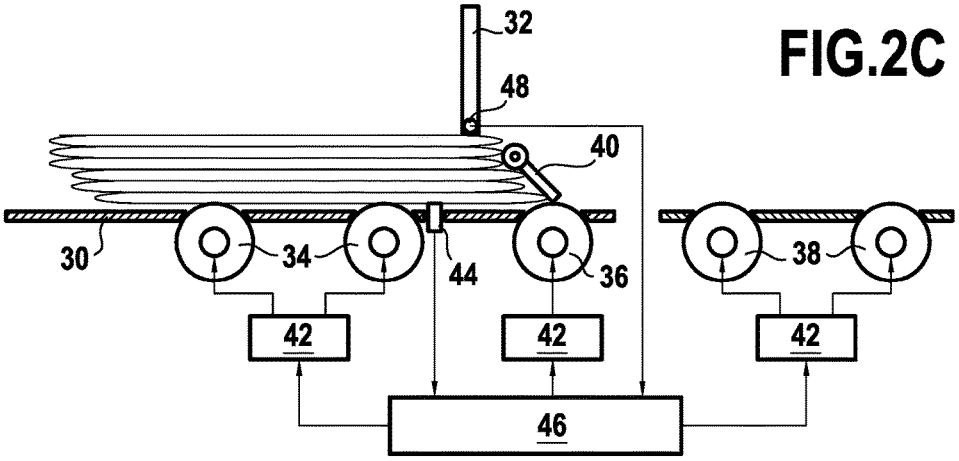

As illustrated in FIGS. 2A to 2C, the feeding module or feeder 12 is conventionally composed of a transport deck 30, a reference wall 32, a plurality of rollers 34, 36, 38 (successively in the envelope flow direction: feed, separation and extraction rollers), a separation mechanism comprising for instance one or several friction pads 40, one or several drive motors 42, and one or several sensors 44. The feeder is controlled by a control unit 46 which can be dedicated to the feeding module or the entire franking machine. Except for the feeding of envelopes which will be described hereafter, the feeder operates in a standard manner and the successive activation of the various rollers during the process of separating and conveying the envelopes do not need to be described here.

In operation, at the beginning of this process, a stack of envelopes is disposed in the feeder. The stack resides on the horizontal transport deck 30 sensibly aligned with the feed rollers 34, their upper part protruding slightly from the deck. The stack is then in front of a reference wall 32, extending vertically from the deck but leaving a clearance path for the envelope to enter the separation area with the friction pads 40 facing the separation rollers 36.

Once the machine is ready to operate, the presence of envelope in the feeder is checked in a conventional manner by the feed sensor 44 located below the transport deck 30 and near the reference wall 32. In this initialization phase if envelopes are detected, the feed rollers 34 are activated to advance the entire stack towards the reference wall at moderate speed, in order to check the height of the stack.

A stack sensor 48 is located in the reference wall 32, preferably just above the clearance path for detecting the presence of envelopes at a predetermined height threshold (reference level). This sensor can be, for instance, a contact sensor protected by a small articulated lever or an optical reflective sensor, also called proximity sensor, which has a detection range of a few centimeters focused around its optical axis. The vertical distance between the stack sensor and the deck is for instance 20 mm. This distance corresponds roughly to a stack of 20 envelopes or 200 gr. As the stack is advanced by the feed rollers 34, the stack sensor checks the presence of envelopes above this reference level. Then, if the stack is higher than the reference level, a higher acceleration (typically 100 $m/s^2$) is applied to the feed rollers to separate the bottommost envelope. Otherwise, a lower acceleration (typically 20 $m/s^2$) is applied to the feed rollers.

As envelopes are extracted, the stack becomes lower and its upper part reaches the level of the stack sensor as illustrated in FIGS. 2A, 2B and 2C that show the feeder with respectively a high, intermediate and low stack. A low stack is detected when the stack sensor 48 is cleared but not the feed sensor 44, indicating that there are still a few envelopes in the feeder. The detection of a low stack triggers the control unit 46 of the franking machines to apply the lower acceleration to the feed rollers (typically 20 $m/s^2$) for the separation of the remaining envelopes.

At any time before the feed sensor is cleared, if envelopes are reloaded on the fly, the stack sensor 48 immediately detects the presence of envelopes above the reference level and the initial, higher, value of the acceleration can be restored.

Figure 3:
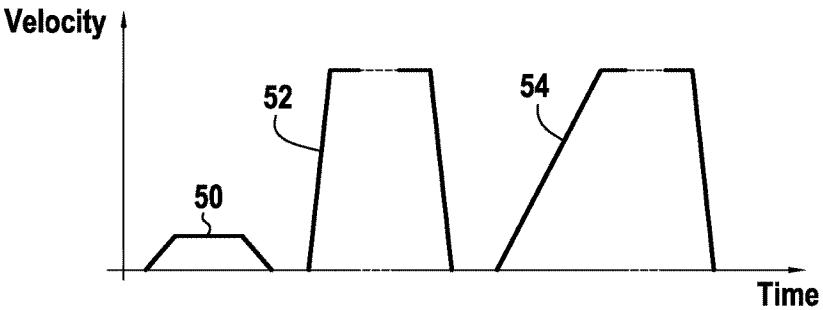
FIG. 3 shows several motion profiles that can be applied to the feed rollers of said feeder.

More particularly, the control unit 46 receives signals from the feed sensor 44 and the stack sensor 48, and selects the motion profile to be applied to the motor 42 driving the feed rollers 34, according to the desired speed and acceleration of the envelopes. For instance, as illustrated on FIG. 3 that shows the various motion profiles to be applied in the various phases, moderate speed and acceleration (typically 0.2 m/s and 20 $m/s^2$) may be used at initialization (curve 50). Then if a stack higher than the predetermined height threshold is detected, high speed and acceleration (typically 1 m/s and 100 m/s$^2$) are used for the separation process (curve 52). Adversely, when a low stack is detected, the same speed but a lower acceleration (typically 20 m/s$^2$) is used (curve 54).

It shall be noted that the separation process may start during the initialization phase (while the stack is moving towards the reference wall) as soon as the height of the stack is determined. The top speed can also differ for high or low stacks, in a manner independent from the selected acceleration. A lower or the same top speed may be preferred for a low stack, depending on other parameters and/or requirements.

It must also be noted that the invention is not limited to the illustrations and that for example other means may be used for driving and separating the envelopes. For instance transport belts may be used instead of feed or separation rollers, and separation belts or rollers may be used instead of friction pads; without departing from the nature of the invention.

The invention claimed is:

1. A feeder for feeding envelopes in a mail handling machine comprising a transport deck for receiving a stack of envelopes, feed rollers for conveying downstream envelopes towards a reference wall leaving a clearance path for the envelopes, a stack sensor for detecting the presence of said stack of envelopes at a predetermined height threshold, and a control unit for activating the feed rollers, wherein the control unit is configured for applying a determined acceleration to said feed rollers and for decreasing said determined acceleration of said feed rollers when the stack of envelopes goes below said predetermined height threshold in order to separate remaining envelopes of the stack.

2. The feeder of claim 1, wherein said acceleration is decreased from a first acceleration to a second acceleration.

3. The feeder of claim 2, wherein said first acceleration is a higher acceleration of 100 m/s2 and said second acceleration is a lower acceleration of 20 m/s2.

4. The feeder of claim 1, wherein said control unit is further configured for maintaining a top speed of said feed rollers when the stack of envelopes goes below said predetermined height threshold.

5. The feeder of claim 1, wherein said control unit is further configured for limiting a top speed of said feed rollers when the stack of envelopes goes below said predetermined height threshold.

6. The feeder of claim 1, wherein said reference wall extends vertically from said transport deck.

7. The feeder of claim 6, wherein said stack sensor is placed in said reference wall just above said clearance path.

8. The feeder of claim 1, wherein said stack sensor is a contact sensor protected by an articulated lever or an optical reflective sensor.

9. The feeder of claim 1, wherein it further comprises a feed sensor located below said transport deck and near said reference wall.

10. The feeder of claim 9, wherein said control unit is further configured for, in an initialization phase, if said envelopes are detected by said feed sensor, activating said feed rollers to advance the entire stack of envelopes towards the reference wall.

11. The feeder of claim 1, wherein it further comprises friction pads facing separation rollers for ejecting one by one said envelopes from said stack.

12. A mail handling machine, comprising:

feeder for feeding envelopes, the feeder comprising:

a transport deck sized, dimensioned and positioned to receive a stack of envelopes;

a number of feed rollers positioned and operable to convey envelopes downstream towards a reference wall leaving a clearance path for the envelopes;

a stack sensor positioned to detect a presence of said stack of envelopes at a predetermined height threshold; and a control unit communicatively coupled to selectively activate the feed rollers, wherein the control unit determines an acceleration to be applied to said feed rollers and decreases said determined acceleration of said feed rollers in response to the stack of envelopes being below said predetermined height threshold in order to separate remaining envelopes of the stack.

13. The mail handling machine of claim 12, wherein the controller decreases said acceleration from a first acceleration to a second acceleration in response to the stack of envelopes being below said predetermined height threshold.

14. The mail handling machine of claim 13, wherein said first acceleration is a higher acceleration of about 100 m/s2 and said second acceleration is a lower acceleration of about 20 m/s2.

15. The mail handling machine of claim 12, wherein when the stack of envelopes is below said predetermined height threshold, said control unit maintains a top speed of said feed rollers.

16. The mail handling machine of claim 12, wherein when the stack of envelopes goes below said predetermined height threshold, said control unit limits a top speed of said feed rollers.

17. The mail handling machine of claim 12, wherein said reference wall extends vertically from said transport deck and said stack sensor is placed in said reference wall just above said clearance path.

18. The mail handling machine of claim 12, wherein said stack sensor is a contact sensor protected by an articulated lever or an optical reflective sensor.

19. The mail handling machine of claim 12, wherein the feeder further comprises a feed sensor located below said transport deck and near said reference wall, and wherein, in an initialization phase, if said envelopes are detected by said feed sensor, said control unit activates said feed rollers to advance the entire stack of envelopes towards the reference wall.

20. The mail handling machine of claim 12, wherein the feeder further comprises a number of friction pads facing separation rollers that eject said envelopes from said stack, one by one.

* * * * *